US005655739A

United States Patent [19]

Teh-Wah Goo

[11] Patent Number: 5,655,739

[45] Date of Patent: Aug. 12, 1997

[54] BAG HOLDER

[76] Inventor: Paul Edward Teh-Wah Goo, 18543 Andiun Ter., Lake Oswego, Oreg. 97034

[21] Appl. No.: 409,513

[22] Filed: Mar. 23, 1995

[51] Int. Cl.[6] ..... B65B 67/04

[52] U.S. Cl. ..... 248/101; 141/390; 141/391

[58] Field of Search ..... 141/390, 391; 248/99, 101, 152

[56] References Cited

U.S. PATENT DOCUMENTS

| | | | |
|---|---|---|---|
| 1,182,412 | 5/1916 | Olesberg | 141/391 X |
| 2,812,784 | 11/1957 | Palmer . | |
| 3,426,958 | 2/1969 | Gore . | |
| 3,893,649 | 7/1975 | Cornell et al. | 248/101 X |
| 4,014,157 | 3/1977 | Pearce | 141/390 X |
| 4,037,778 | 7/1977 | Boyle . | |
| 4,312,531 | 1/1982 | Cross | 248/99 X |
| 4,664,348 | 5/1987 | Corsaut, III et al. | 248/99 |
| 4,768,742 | 9/1988 | Kaaloa | 248/99 |
| 4,832,292 | 5/1989 | Beckham | 248/99 |
| 5,009,378 | 4/1991 | Linsmeyer et al. | 248/99 |
| 5,014,943 | 5/1991 | Nelson et al. | 248/99 |
| 5,031,948 | 7/1991 | Groth et al. | 294/1.1 |
| 5,065,965 | 11/1991 | Aulabaugh | 248/99 |
| 5,106,041 | 4/1992 | Jelincic | 248/99 |
| 5,107,666 | 4/1992 | Rahtican | 248/99 |
| 5,149,028 | 9/1992 | Blackaby et al. | 248/101 |
| 5,222,536 | 6/1993 | Hodgdon et al. | 141/390 |

*Primary Examiner*—John A. Ricci
*Attorney, Agent, or Firm*—Quirk & Tratos

[57] ABSTRACT

A bag holder comprises a scoop and a locking ring for engaging the scoop and maintaining a bag in position on the scoop. The scoop is a hollow device with a mouth and a base. A channel extends inwardly from the mouth of the scoop towards the base. In use, a bag is retained in an open position between the ring and the base of the scoop, and a user funnels debris into the mouth, through the scoop, and into the bag.

11 Claims, 4 Drawing Sheets

BAG HOLDER

FIELD OF THE INVENTION

The present invention relates to a device for use in filling a trash bag. More particularly, the invention is a device which maintains a trash or leaf bag in an open position and aids a user in guiding trash into the open bag.

BACKGROUND OF THE INVENTION

Users of trash and leaf bags constantly confront a recurring problem of maintaining the end of the bag in an open position while at the same time guiding debris and trash into the bag. This problem is especially acute when using plastic bags, as these bags have virtually no rigidity and are not self-supporting.

A common situation where a person experiences difficulty in simultaneously maintaining the bag in an open position and locating debris in it arises when raking leaves. A user rakes leaves from his lawn into one or more piles, with the intent of putting them into a trash bag for disposal.

The user places a trash bag adjacent the pile of leaves, and then fills the bag with the leaves. This process is very difficult, however, because the sidewall of the otherwise open end of the bag closes upon itself, preventing the user from getting the leaves into the bag. Thus, the user must either hold the bag open with one hand and then attempt to rake or scoop the leaves into the bag with his other hand, or grasp leaves with both hands and then force the leaves through the collapsed end of the bag.

When the user attempts to hold the bag open and rake or push the leaves into the bag, he encounters a second problem. The problem is that the bottom and sides do not remain in a fixed position, so that when he presses the leaves inwardly towards the bag, the bag deforms and many of the leaves never make it into the bag, but instead fall on the ground outside the bag sidewall.

In other instances, the user of a bag must maintain the bag in an open position when it is partially full and resting in an upright position on its closed bottom end. In the situation where the bag is partially full, the bag cannot be placed on its side or the contents spill out as fast as the user attempts to put additional material in. Thus, when a user attempts to fill the top portion of the bag, he must maintain the bag in an open and upright position while at the same time moving the debris and trash into the bag.

A need exists for a device which maintains a bag in a fixed, open position and aids a user in guiding debris and trash into the open bag.

SUMMARY OF THE INVENTION

A two-piece device for retaining a trash bag in open position for receiving refuse comprises a scoop portion and a locking ring for fastening the bag opening to a base of the scoop. The scoop is a rigid, hollow, tubular device which has a base or rearward portion adapted to receive the bag opening, and a mouth or forward portion designed to receive the refuse. The scoop tapers inwardly from the mouth to the base.

The locking ring is placed inside the bag opening, maintaining the bag opening in a generally circular open position. The device is assembled by sliding the ring and bag through the scoop, with interengaging locking means on the exterior of the locking ring and the interior of the scoop base retaining the bag opening in place at the base of the scoop. Preferably, the locking means comprises a plurality of peripheral tabs or ribs on the exterior of the ring and a plurality of mating grooves on the interior of the scoop base.

The scoop mouth has a flat lip portion to facilitate the scooping of debris into the scoop and bag from a flat surface such as a driveway or lawn. A channel extends inwardly of the mouth through the scoop, permitting a user to move a rake or similar device into the scoop, pushing debris into a bag connected to the scoop.

As assembled, the device has the locking ring engaged in the base of the scoop, with the bag mouth firmly held in the annular space between the locking ring and the scoop.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
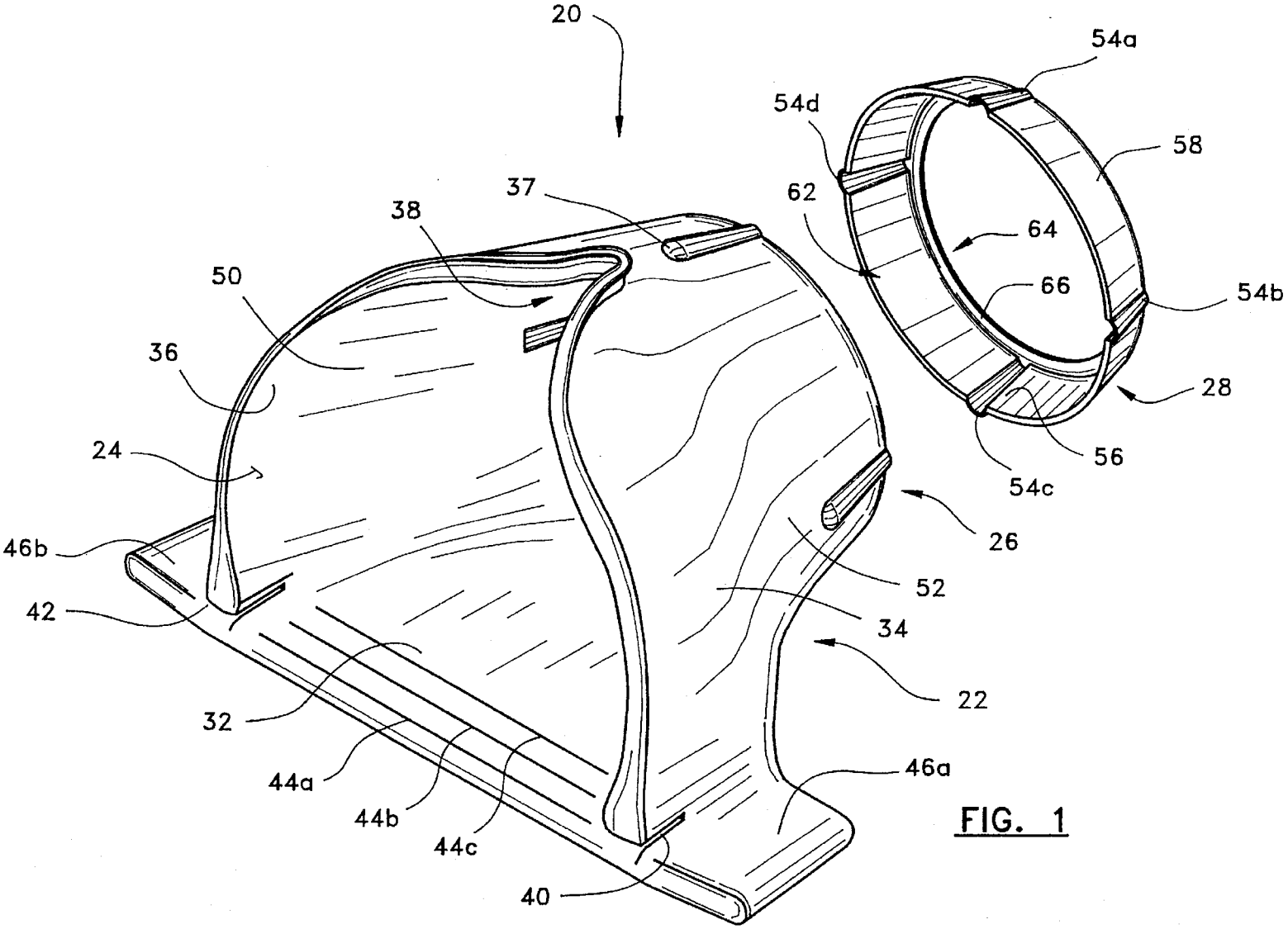
FIG. 1 is a perspective view of a scoop and a locking ring of a bag holder of the present invention.
Figure 2:
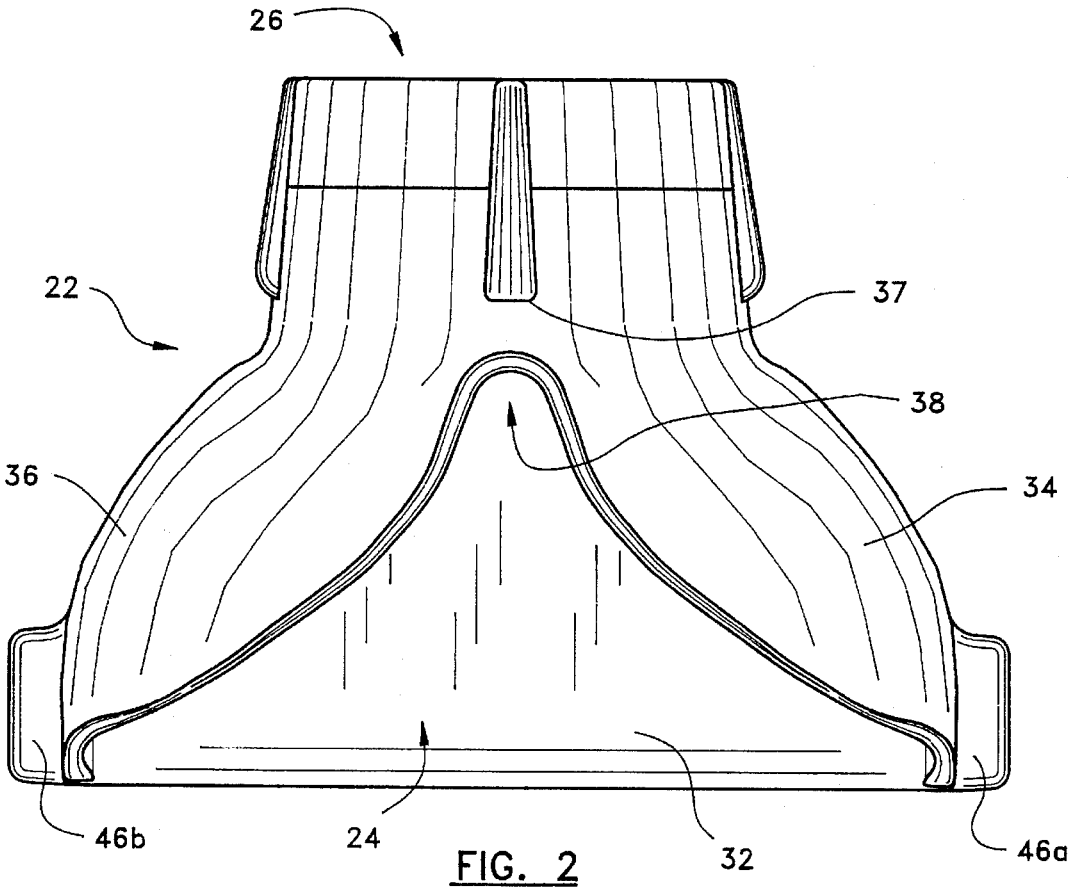
FIG. 2 is a top view of the scoop illustrated in FIG. 1.
Figure 3:
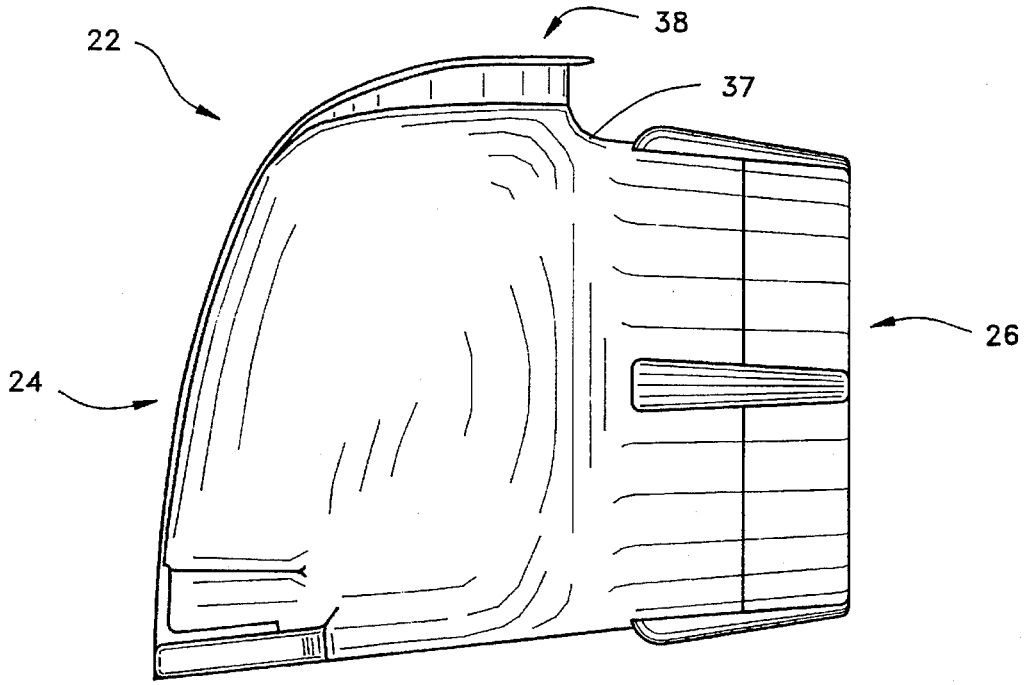
FIG. 3 is a side view of the scoop illustrated in FIG. 1.
Figure 4:
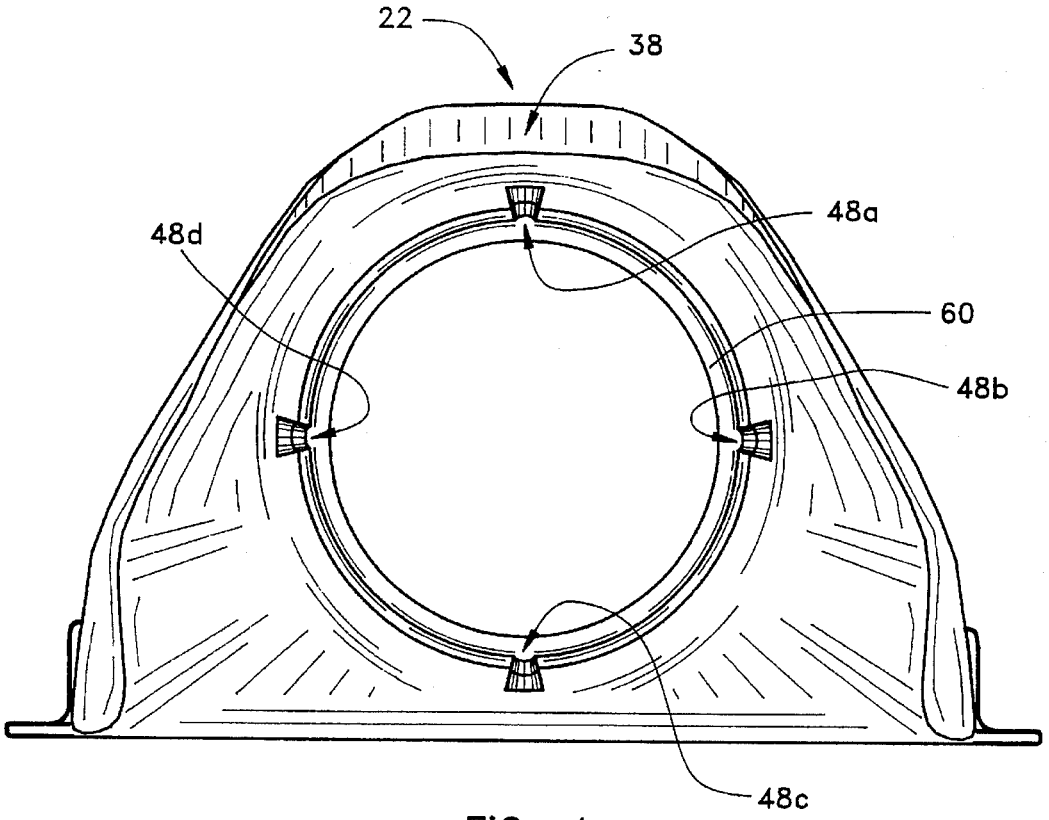
FIG. 4 is a front end view of the scoop illustrated in FIG. 1.

FIG. 1 illustrates a bag holder 20 in accordance with the present invention. In general, the holder 20 comprises means for maintaining a bag in an open position and for funneling debris into the bag in the form of a bag support or scoop 22 having a front intake end or mouth 24 and a rear bag supporting end or base 26, and means for retaining the bag on the scoop in the form of a bag retaining ring 28.

In use, a bag 30 (see FIG. 6) is retained in an open position on the scoop 22 by positioning the sidewall of the bag between the base 26 of the scoop and the bag retaining ring 28. A user moves refuse, trash, debris and other material into the mouth 24 of the scoop, through the hollow scoop, and into the open end of the bag 30.

More particularly, and referring to FIGS. 1–5, the scoop 22 is a somewhat tubular sleeve, having a contiguous hollow wall means with an open mouth 24 and open base 26. The wall means of the scoop 22 preferably comprises a substantially flat bottom section 32, first and second side walls 34, 36 which extend upwardly from either side of the base section 32, meeting at a top section 37 above the bottom section 32. The bottom 32, side walls 34, 36, and top 37 taper inwardly from the mouth 24 to the base 26 of the scoop towards a centerline therethrough.

The bottom 32 is about 29 inches wide at the mouth 24, and substantially flat. The side walls 34, 36 each extend upwardly nearly perpendicular to the bottom 32 about 4–6 inches, and then bend inwardly towards one another, meeting about 19 inches above the bottom 32, thus forming the top section 37.

The side walls 34, 36 extend at an angle inwardly towards one another along the bottom 32, which narrows from the mouth to the base. The bottom 32 and sidewalls 34, 36 meet at the open, primarily hollow circular base 26. Preferably, the distance from the mouth to the base 24, 26 is about 16 inches. Because the sidewalls 34, 36, top section 37, and bottom 32 are interconnected, they form a contiguous hollow support having an interior surface 50 and exterior surface 52.

Most importantly, a channel 38 extends rearwardly from the mouth 24 of the scoop about 10 inches through the top section 37. The channel 38 is about 20 inches wide at the mouth 24, and narrows towards the base 26 of the scoop to about 3 to 8 inches. Preferably, the channel 38 extends parallel to the centerline of the scoop 22, and is at least as wide as a rake handle or similar item.

Slots 40, 42 extend inwardly along the scoop 22 at the junction of each side wall 34, 36 with the bottom 32. In particular, the slots 40, 42 are about 1–4 inches long.

A foot pad 46*a,b* extends outwardly from each side of the scoop 22 at the mouth 24. In particular, each pad 46*a,b* is a substantially flat platform extending outwardly from the scoop 22 at the connection of the sidewalls 34, 36 with the bottom 32. The pads 46*a,b* are each about 3 inches deep and 5 inches in length.

Preferably, the bottom 32 includes a number of steps 44*a,b,c*. Each step extends across the bottom 32 between the sidewalls 34, 36, the steps becoming shorter the closer they are to the base 26 of the holder 20. The steps 44*a,b,c* comprise ridges in the bottom 32 for adding rigidity to the base section.

The edge of the side walls 34, 36 and the top section 37, including that portion surrounding the channel 38, at the mouth 24 of the scoop 22 curves rearwardly towards the base. In particular, at the mouth 24, the sidewalls 34, 36 and top section 37 curls back upon itself, presenting round, smooth lip or edge at the mouth 24. On the other hand, the mouth at the bottom 32 is substantially flat and smooth for engagement with a flat surface on which the holder 20 is resting.

As described above, the bottom 32, sidewalls 34, 36 and top section 27 extend rearwardly merging at the base 26 of the scoop 22. At the base 26, the scoop 22 is circular in shape. In particular, the base 26 of the scoop 22 comprises a circular rim.

At the point where the sidewalls 34, 36, top section 37, and bottom 32, form a substantially tubular sleeve, the scoop 22 has an inner diameter of about 17–18 inches, narrowing at the base 26 of the scoop 22 to a diameter of about 15–16 inches. Thus, the diameter of the circular portion of the scoop 22 tapers towards the base.

Interengaging locking means are provided for retaining the ring 28 on the scoop 22. Preferably, the interengaging locking means includes a number of grooves 48*a,b,c,d* (see FIG. 4) located in the interior surface 50 of the scoop at the base 26 for engagement with ribs or tabs located on an outer surface of the ring 28.

More particularly, four longitudinal grooves 48*a,b,c,d* are spaced equidistantly about the interior of the rim and extend about 4–8 inches towards the mouth 24 of the scoop. Each groove 48 is preferably an elongate trough with a semi-circular cross-section which tapers in depth and width from the mouth 24 towards the base 26 of the scoop. In order to strengthen the area of the scoop 22 around the grooves 48, the scoop is thickened by locating ribs on the exterior surface 52.

In the preferred embodiment, a flange or lip 60 forms a ring stop at the base 26. Preferably, the lip 60 extends inwardly about 0.5–2 inches around the inner circumference of the scoop at the base.

The bag securing ring 28 for use with the scoop 22 is hoop-shaped or annular, having an inner surface 56 and outer surface 58. The ring 28 has a front end 62 and rear end 64 corresponding to the same ends of the scoop 22. The inner diameter of the ring 28 varies, narrowing in diameter from the front end 62 to the rear end 64, matching the interior diameter of the scoop 22 at the base 26. The ring 28 is about 3 inches deep, and includes a number of tabs or ribs 54*,a,b,c,d* located about the outer surface 58 thereof.

Each tab 54 is preferably spaced about the outer surface of the ring 28 with the same spacing as the grooves 48 in the scoop. Preferably, each tab 54 extends outwardly from the ring 28 about 0.1–1 inches, for partial mating engagement with the grooves 48 in the scoop. Each tab 54 has a semi-circular cross-sectional shape and tapers in width from the front end 62 to the rear end 64 to match the shape of the grooves 48 in the scoop.

The front end 62 of the ring 28 includes an inwardly extending lip 66 for partial engagement with the lip 60 at the base of the scoop 22.

Preferably, the holder 20 is made of plastic or other similar light-weight and rugged material. When made of plastic, the holder 20 is preferably molded in two pieces. In this method of manufacture, the ring 28 is formed separately from the scoop 22.

In an alternate method of manufacture, the ring 28 is formed as an extension of the scoop 22, with the two pieces initially molded as single piece. Then, the ring 28 is cut off of the rim so that it becomes a separate piece.

Figure 5:
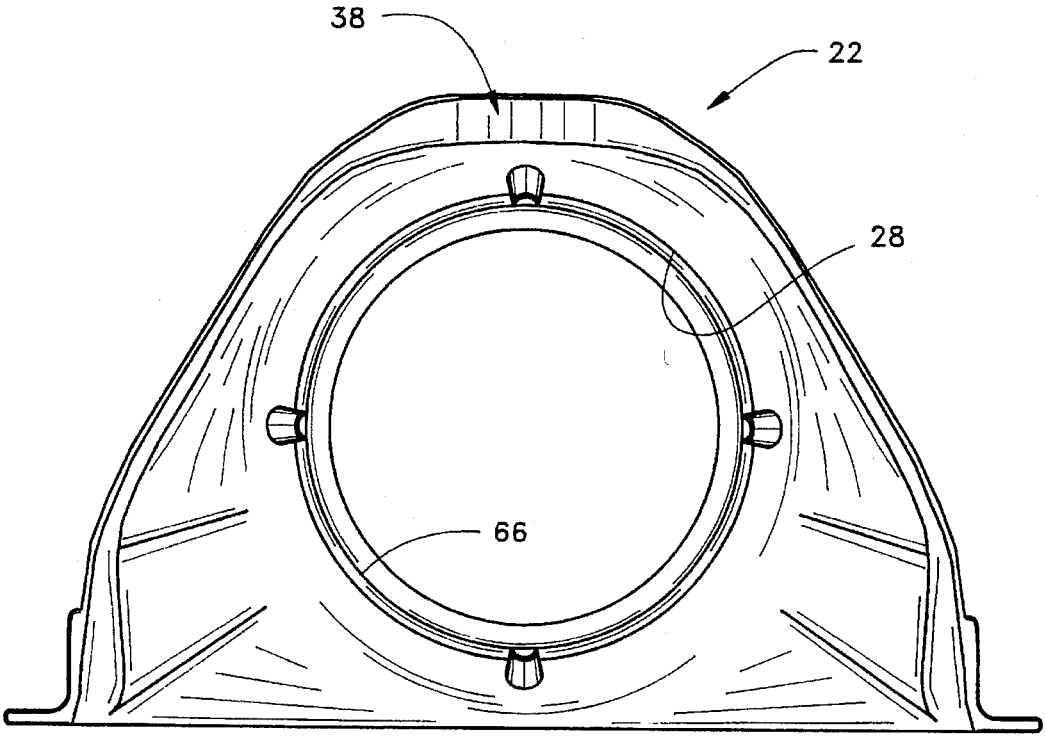
FIG. 5 is a front end view of the scoop illustrated in FIG. 1 with a locking ring therein.
Figure 6:
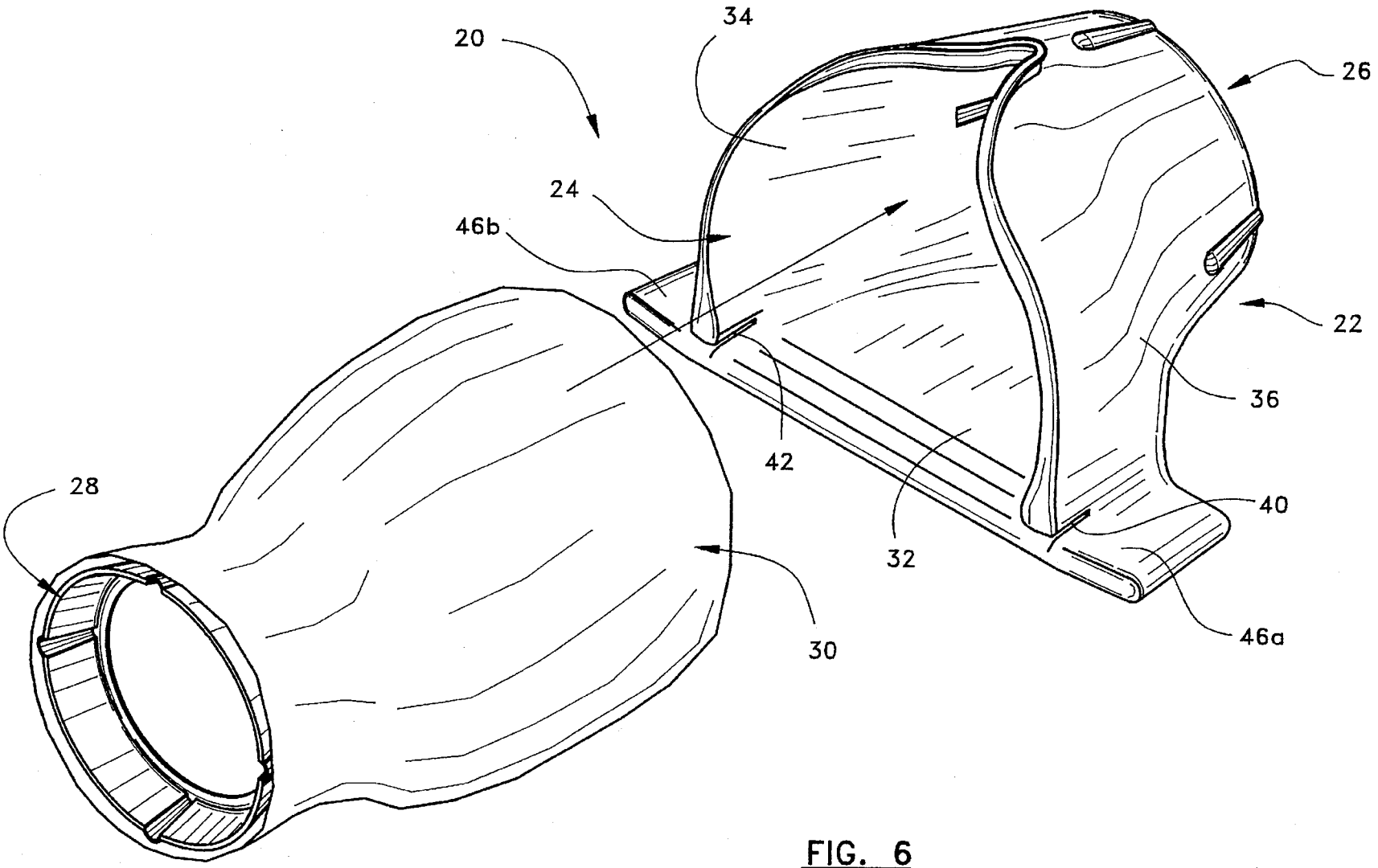
FIG. 6 is an exploded view of the bag holder illustrated in FIG. 1 with a bag.

Use of the present invention is described below in conjunction with FIGS. 1, 5 and 6. With the ring 28 separated from the scoop 22, a user locates the ring 28 inside of the open end of a bag 30. The user then presses the ring 28 into the scoop 22 through the mouth 24, moving it towards the base 26.

As the ring 28 reaches the base 26 of the scoop 28, the user aligns the tabs 50 on the ring with the grooves 48 in the scoop and presses the ring 28 rearwardly until its movement is prohibited by the lip 60 and engagement of the tabs with grooves. At this time, the sidewall of the bag 30 at the open end thereof is located between the ring and the scoop.

The user then pulls the bag 30 through the scoop until it extends rearwardly of the device. Once in this position, the user puts a foot on the closest foot pad 46*a,b* and rakes or pushes leaves and other debris through the scoop 22 and into the bag 30. In particular, movement of a rake or other tool to push the debris into the bag 30 is facilitated by the channel 38 in the scoop 22. A user can pull the handle of the tool through the channel 38 such that the rake or other debris-engaging portion of the tool is located deep within the scoop 22.

Because the user can move the tool through the channel into the scoop 22, debris is directed into the bag 30 and does not fall out. In particular, because the channel 38 extends rearwardly of the mouth, debris forced into the scoop 22 is blocked from moving anywhere but into the bag 30.

Further, placement of the sidewall of the bag 30 between the ring 38 and the base of the scoop 22 effectively prevents the bag 22 from moving with respect to the holder 20 during use. This arrangement retains the bag 30 in an open position on holder 20 without the need for the user to grab the bag 30 or otherwise hold it in place.

Once the bag 30 is full, the user stands the bag upright with the holder 20 still attached to it. The user then releases the bag from the holder by removing the ring 28 from the scoop 22. With the bag already upright, the user ties the bag shut and disposes it.

A user easily ties the bag shut by pulling the loose top end through one of the slots 40, 42 in the scoop. When engaging one of the slots 40, 42, the sidewall of the bag is bunched up. A user can then easily put a bag tie on the bag or knot the bag.

The user may also attach a bag and fill it in an upright position. In this case, the ring 28 acts as a base for the holder 20. The user places debris into the holder 20, raising it above the ground if necessary to allow debris to fall deep into the bag 30.

While it is preferred that the locking ring inter-engage the scoop to lock a bag into place, other means for locking or retaining the bag on the device are available. For example, the ring may friction-fit into the scoop, be spring-loaded and expandable, attached by hooks, snaps, pins or the like.

Further, while the holder 20 is preferably made of molded plastic, it can be made of metal, such as light-weight and weather-resistant aluminum. Also, the scoop need not comprise a single piece, but can comprise several connectable pieces.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A bag holding device, comprising:

a bag support having an open mouth and an open base, a bottom section, first and second side walls, a top, and an interior surface, and further including a channel extending through said top from said mouth toward said base;

a locking ring for engagement with the base of said bag support, said ring comprising an annular member having an inner surface and an outer surface; and at least one groove located on said interior surface of said support and at least one tab located on said outer surface of said ring for engagement with said groove in said support.

2. The holder of claim 1, wherein four grooves are located in said interior surface of said support, and four tabs are located on said outer surface of said ring for engagement with said grooves.

3. The holder of claim 1, wherein four grooves having the shape of a semi-circular trough which taper in width towards the base are located on said support, and four ribs which taper in width from a first end to a second end of said ring are located on said outer surface of said ring for engagement with said grooves.

4. The holder of claim 3, wherein said bottom of said support at said mouth is flat.

5. The holder of claim 4, wherein at least one foot pad is located on said support.

6. The holder of claim 1, wherein said channel narrows in width from said mouth towards the base.

7. In combination, a bag having a side wall and an open end and a bag holder, said holder comprising a scoop having a mouth, base, and a passage therethrough, a bag locking ring comprising an annular member, and locking means for retaining the side wall of said bag at said open end between said bag ring and said base of said scoop, said locking means comprising at least one groove located in said scoop for engagement with at least one tab located on said ring.

8. The combination of claim 7, wherein four grooves are located in said scoop for engagement with four tabs located on said ring.

9. The combination of claim 7, wherein at least one notch is located in said scoop.

10. The combination of claim 7, wherein said scoop includes at least one outwardly extending foot pad.

11. A method of supporting a bag having a sidewall and an open end, comprising the steps of:

locating a locking ring inside the sidewall of a bag at an open end thereof;

pressing said locking ring and bag through the mouth of a scoop;

engaging said locking ring with said scoop; and retaining said open end of said bag in an open position.

* * * * *